US006655912B2

(12) United States Patent
Bos

(10) Patent No.: US 6,655,912 B2
(45) Date of Patent: Dec. 2, 2003

(54) GUIDE VANE STAGE OF A COMPRESSOR

(75) Inventor: Mathieu Bos, Zonhoven (BE)

(73) Assignee: Techspace Aero S.A. (BE)

( * ) Notice: Subject to any disclaimer, the term of this patent is extended or adjusted under 35 U.S.C. 154(b) by 86 days.

(21) Appl. No.: 10/001,122

(22) Filed: Nov. 30, 2001

(65) Prior Publication Data

US 2002/0085913 A1 Jul. 4, 2002

(30) Foreign Application Priority Data

Dec. 6, 2000 (EP) ..... 00870290

(51) Int. Cl.[7] ..... F01D 9/04
(52) U.S. Cl. ..... 415/209.4
(58) Field of Search ..... 415/119, 185, 415/189, 191, 208.1, 208.2, 209.3, 209.4, 210.1; 416/214 A, 219 R, 220 R, 221, 248, 500

(56) References Cited

U.S. PATENT DOCUMENTS 2,812,159 A 11/1957 Krebs ..... 415/119
4,452,564 A * 6/1984 Conant et al. ..... 415/210.1 X
5,399,069 A * 3/1995 Marey et al. ..... 415/209.3
5,569,019 A 10/1996 Katariya et al.
6,409,472 B1 * 6/2002 McMahon et al. ... 415/209.4 X

FOREIGN PATENT DOCUMENTS

| | | |
|---|---|---|
| FR | 2671140 | 7/1992 |
| GB | 748912 | 5/1956 |

* cited by examiner

*Primary Examiner*—Edward K. Look
*Assistant Examiner*—Richard A. Edgar
(74) *Attorney, Agent, or Firm*—Knobbe, Martens, Olson & Bear LLP

(57) ABSTRACT

The present invention relates to a guide vane stage of a compressor comprising an outer ring and an inner ring, which are both concentric and preferably circular. The rings are connected to each other via a series of fixed vanes, and are characterized in that at least the inner ring is provided with holes or apertures which allows one of the ends of the vanes to pass through these holes or apertures. The vanes also have at their end a second aperture intended to allow the passage of a retaining and rigidifying component having an elastic function, in order to hold them in pairs.

8 Claims, 2 Drawing Sheets

FIG. 2
(PRIOR ART)
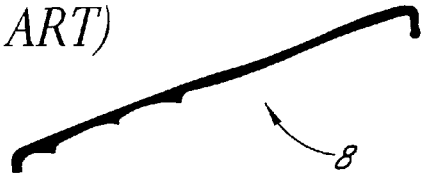
FIG. 3
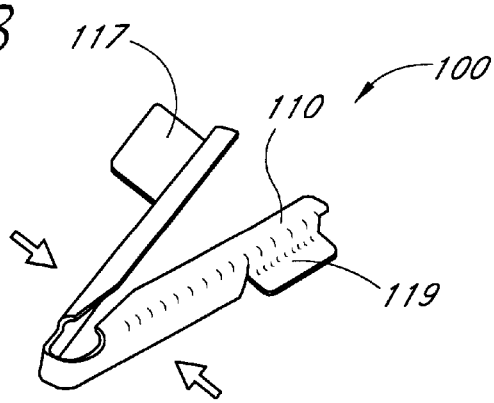
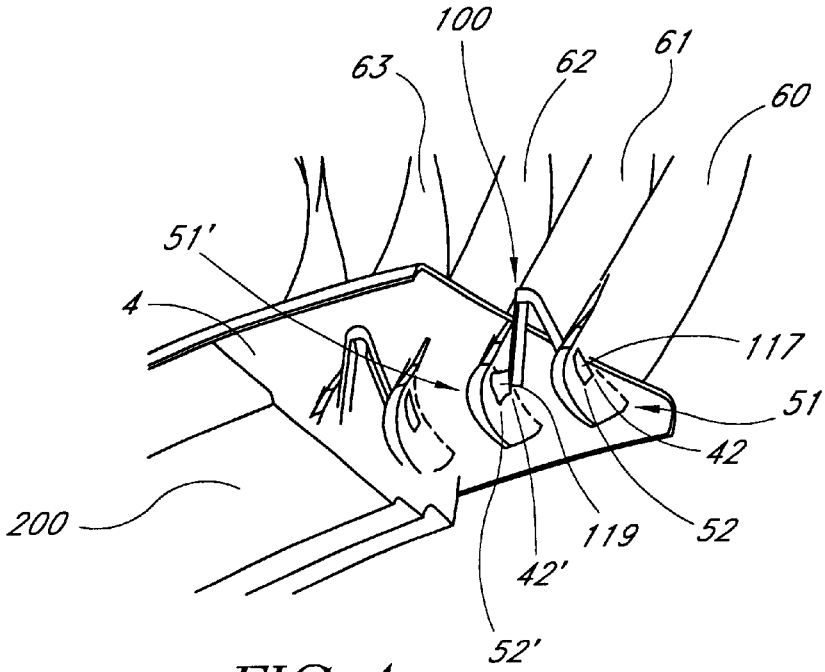
FIG. 4

GUIDE VANE STAGE OF A COMPRESSOR

CROSS-REFERENCE TO RELATED APPLICATIONS

This application claims priority to European Application No. 00 870 290.4, filed Dec. 6, 2000, the disclosure of which is herein incorporated by reference in its entirety.

BACKGROUND OF THE INVENTION

1. Field of the Invention

The present invention relates to a guide vane stage of a compressor, comprising a succession of guide vane or stator stages separated by rotor stages of rotating vanes, each guide vane stage consisting of fixed vanes connecting an inner ring to an outer ring.

2. Description of the Related Art

Coaxial compressors are well known per se, and are used in several types of application. In particular, they are used in twin-structure engines, turbofan engines and turbojet engines. It is also noted that they are present in power stations. These low-pressure or high-pressure compressors substantially consist of several rotating vane stages or rotor stages separated by stator stages or guide vane stages whose function is to reposition (rectify) the speed vector of the fluid exiting the preceding stage before sending it to the next compartment.

Each of these guide vane stages substantially consists of fixed vanes connecting an outer ring to an inner ring, both of which are concentric.

The problem is that these guide vane stages are submitted to relatively large forces due, in particular, to the vibrations, which rapidly cause wear by fatigue.

In order to solve this problem of fatigue, it has been proposed to rigidify the rings. By rigidifying the rings, and in particular the inner rings of the first compression stages, it is in fact possible to shift the Eigen frequencies of certain stress modes which excessively wear said rings.

Several rigidification solutions have been envisaged. In particular, the use of stiffeners in the form of strips which are machined on the inner ring or on the outer ring and on the non-functional side has been proposed. It has also been proposed to machine steps into the metal sheet of the inner or outer ring. These strips or steps may also consist of a component mounted by welding or riveting. In addition, in order to improve the sealing from one stage to the next, it is common practice to arrange under the metal sheet of the inner ring of the guide vane an elastomeric member which seals the fixed vane to the inner ring and which will also act as a seal between the rotating and fixed members. This makes it possible to avoid any backflow of gases towards the preceding stage, which might lead to an engine stall in the case of a turbofan engine.

Nevertheless, the various solutions proposed according to the prior art are relatively expensive solutions given that a relatively large amount of material is needed to machine the sheet metal of the rings.

Another major problem in the case of the guide vane stages of a compressor is that said vanes should be securely fastened to the rings in a particularly efficient manner. Specifically, this fastening of the vanes to the rings must be optimal so as to be able to withstand accidents such as the breaking of a vane or the ingestion of a foreign body such as a bird into said turbojet engine.

Furthermore, a displacement of the vanes relative to the rings causes extensive wear with a "fatigue crack" which can lead to the breaking of said vanes or even of the ring.

Usually, the vanes are fastened to the rings, both the inner and outer ring, by means of rivets or welds. Nevertheless, the use of these means of fastening has the major drawback of disrupting the flow and of generating a loss of pressure in the aerodynamic stream.

British Patent No. A-748 912 discloses a blade assembly for compressors comprising a plurality of blade elements and a shroud structure, said shroud structure consisting of an inner skin and an outer skin, said skins being formed with slots in radially-aligned pairs. The end of each blade element is mounted in the shroud structure by extending through an aligned pair of said slots and is retained in position by means of a first mechanical abutment between said end and one of said skins to limit the length of the blade element which extends through the slots, and by means of a second mechanical abutment to prevent disengagement of the blade element from the slots. The first mechanical abutment consists in a shoulder provided on said end which co-operate in abutment with the inner surface of the outer skin. The second mechanical abutment consists in an associated strip-like wedging member co-operating with a dovetail notch provided on said ends and with the outer surface of the outer skin.

U.S. Pat. No. 2,812,159 discloses a device for assembling vanes comprising a series of U-shaped components, each of said vanes being provided with a hole at the bottom of the "U" which fits the free end of said vanes, said assembling being secured by means of fastening means comprising among other things screws and which are adapted so as to prevent lateral and axial movements of the vanes. However, the problem of the disruption of the aerodynamic flow stream encountered when screws or similar fastening means are used, is still existing.

French Patent No. A-2 671 140 discloses a stator assembly in a turbocompressor, comprising an outer ring and a series of stator vanes retained to said outer ring, wherein the outer end of each vane takes the form of a wedge and the outer ring has prismatic slots complementary to said wedge so that the outer ring fits said prismatic slots and the stator vanes are retained thereby to said outer ring. The stator vanes are maintained in position by means of both notches and a metallic element, preferably elastic, which rests on the end face of each vane.

U.S. Pat. No. 5,569,019 discloses a fan stator assembly comprising an inner and outer shrouds provided with apertures through which vanes pass, said vanes being radially restrained to the inner and outer shrouds by means of seals. Each vane substantially consists of two parts, an airfoil section and a foot. The vanes preferably comprise a non-metallic composite material consisting of a plurality of compression molded, heat cured plies, including plies of para-aramid fibers which are continuous throughout the airfoil section and the foot of the vanes but are discontinuous (cut) at the junction of airfoil section with foot.

SUMMARY OF THE INVENTION

The present invention aims to propose a solution for combining the functions of rigidification of the inner ring and retention of the vanes of a guide vane stage of an axial compressor.

In particular, the present invention aims to provide a solution which offers great ease of assembly and which requires no additional assembly operations.

The present invention aims also to propose a solution in which the aerodynamic flow stream is not affected by the presence of welds or rivets on the ring.

The present invention aims also to produce a solution of rather low cost.

The present invention relates to a guide vane stage of a compressor comprising two rings, an inner ring and an outer ring, which are both concentric and preferably circular and connected to each other via a series of fixed vanes. At least the inner ring is provided with holes or apertures that allow said vanes to pass through these holes. The vanes themselves have, at their end that will be arranged on the inner ring side, a second aperture intended to allow the passage of a retaining and rigidifying component having an elastic function. This retaining and rigidifying component will advantageously make it possible to securely fasten the vanes in pairs on the non-functional side, that is to say on the inner face side, of the inner ring.

According to one particularly preferred embodiment, this retaining and rigidifying component is in the form of a metal sheet cut, shaped and folded in two and is provided with two flat stubs intended to be housed in the apertures of two successive vanes.

In a particularly advantageous manner, the fact that this component is folded allows it to act as a spring, for example a spring of "hairpin" type.

In a particularly advantageous manner, it is observed that the mounting will be quick and simple, and will be carried out by exerting a precompression on said retaining and rigidifying component which will then be positioned in the two apertures of two successive vanes and will then simply be released. Once this component is mounted, the spring effect separates the two successive vanes connected together.

In a particularly advantageous manner, said component will be placed against the edge of the apertures of the ring.

In a particularly advantageous manner, this causes an effect of retaining said vanes on the inner ring, but also an effect of rigidifying the entire inner ring, thus allowing a shift of the Eigen frequencies of certain stress modes on the vanes.

BRIEF DESCRIPTION OF THE DRAWINGS

FIG. 2 shows a detail of FIG. 1 showing the rigidifying device according to the prior art comprising stiffeners on the inner ring.

FIG. 3 shows the retaining device used in the solution according to the present invention.

FIG. 4 shows the retaining device according to the invention arranged on an inner ring and on two successive vanes so as to allow said inner ring to be rigidified and to allow the retaining function of the vanes on this ring.

DETAILED DESCRIPTION OF THE PREFERRED EMBODIMENT

Figure 1:
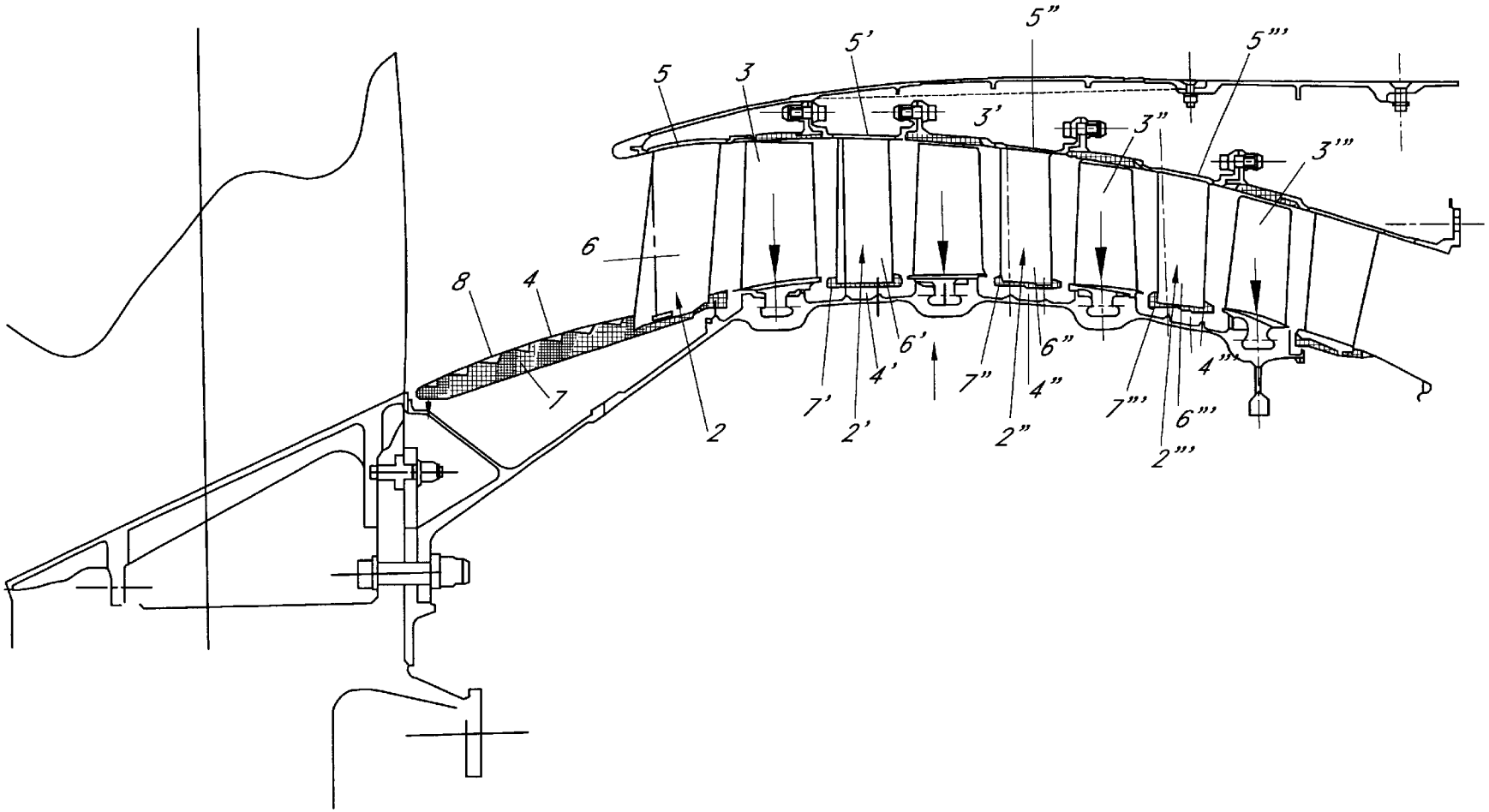
FIG. 1 (PRIOR ART)
FIG. 1 shows a general view of the compression stage of a turbofan engine with a vane rigidifying device according to the prior art.

FIG. 1 shows the compression stage of a turbofan engine. This compression stage is composed of two types of components:

- on the one hand, moving parts which substantially consist of the rotor 1 provided with several series of moving vanes 3, 3', 3", etc. corresponding to several successive rotor stages, and
- on the other hand, fixed parts constituting the guide vane stator stages 2, 2', 2", etc. separating the rotor stages 3, 3', 3", etc.

Each guide vane stage 2, 2', 2", etc. substantially consists of an inner ring 4, 4', 4", etc. respectively, an outer ring 5, 5', 5", etc. respectively, and a series of fixed vanes 6, 6', 6", etc. respectively, connecting said inner ring and outer ring.

Preferably, said inner rings 4, 4', 4", etc. and said outer rings 5, 5', 5", etc. are specific to each of the guide vane stages 2, 2', 2", etc. More specifically, the inner rings 4, 4', 4", etc. and the outer rings 5, 5', 5", etc. are in the form of metal sheets in the form of collars, whereas the series of fixed vanes 6, 6', 6", etc. correspond to metal sheets radially connecting an inner ring to an outer ring for each series.

In addition, usually, an elastomeric component 7, 7', 7", etc. is present on the inner surface of the corresponding inner rings 4, 4', 4", etc. These elastomeric components 7, 7', 7", etc. act as seals between two successive rotor and stator stages.

The gas first crosses the first guide vane stage 2 of the compressor where its speed vector is repositioned in order to be entrained by the first rotor stage of rotating vanes 3 before joining the second guide vane stage 2' to be again repositioned at 3', etc. The gas thus undergoes an entrainment-repositioning cycle at the end of which its kinetic energy gradually decreases while its pressure increases.

According to the prior art and as shown in FIGS. 1 and 2, steps 8 are machined into the sheet metal of the inner ring 4 to rigidify said ring, and in particular the first guide vane stage 2.

The alternative proposed by the present invention consists in rigidifying a ring while at the same time ensuring a function of retaining the vanes on said ring.

The component 100 for retaining the vanes is described in detail in FIG. 3. It is observed that it is substantially in the form of a cut, shaped and folded metal sheet 110 provided with two flat stubs 117 and 119. The configuration and composition of the metal sheet 110 are such that the component 100 can be likened to a spring of "hairpin" type.

FIG. 4 shows the principle upon which the present invention is based and explains how the retaining and rigidifying component 100 is arranged on a ring and on two successive vanes to ensure both rigidification of this ring and retention of the two successive vanes on this ring. According to this principle, the ring, and preferably the inner ring 4, is provided with holes or apertures 42, 42' which allow attachment, preferably onto the inner face of said ring 4, of the successive vanes 60, 61, 62, etc. via their ends 51, 51'. The ends 51, 51' of said vanes themselves have apertures 52, 52'. Said vanes 60, 61, 62, etc. are securely fastened to the ring 4 by means of the retaining and rigidifying component 100. More specifically, the flat stubs 117 and 119 of said retaining and rigidifying component 100 are housed in apertures 52, 52' of the two successive vanes 60, 61, 62 etc. The retaining and rigidifying component 100 thus makes it possible to securely fasten the vanes in pairs (60 and 61, 62 and 63, etc.) on the guide vane stages. In concrete terms, to install the retaining and rigidifying component 100 on the vanes 60, 61, 62, etc., a precompression is exerted on it (see the arrows in FIG. 3) as would be exerted by using sugar tongs. The component 100 is then positioned such that its flattened stubs 117, 119 are housed in the apertures 52 and 52', respectively, of the successive vanes 60, 61, 62, etc. Finally, said component 100 is simply released. Once mounted, the spring effect of the retaining and rigidifying component 100 acts by keeping the successive vanes 60, 61, 62, etc. spaced apart.

Finally, it is common practice to bury the entire device, that is to say the retaining and rigidifying component 100 and the ends of the vanes, in an elastomeric component 200 which allows the end of the vane to be sealed to the ring.

In addition, this also allows the sealing of the entire guide vane stage to be increased.

What is claimed is:

1. A guide vane stage of a compressor comprising:

an outer ring;

an inner ring concentric with said outer ring;

a plurality of fixed vanes connecting said outer ring and said inner ring; and a retaining and rigidifying component for holding said vanes in pairs;

wherein said inner ring comprises apertures through which one end of said vanes passes, and wherein said vanes comprise an aperture through which said retaining and rigidifying component passes.

2. The guide vane stage of claim 1, wherein said outer ring and inner ring are circular.

3. The guide vane stage of claim 1, wherein said retaining and rigidifying component is a spring.

4. The guide vane stage of claim 1, wherein said retaining and rigidifying component has a hairpin configuration.

5. The guide vane stage of claim 3, wherein said spring comprises a cut, shaped and folded metal sheet comprising two flat stubs which are sized so as to allow them to be housed in the apertures of two successive vanes.

6. The guide vane stage of claim 1, wherein an end of the fixed vanes is buried in an elastomeric component.

7. The guide vane stage of claim 1, wherein said outer ring comprises apertures through which one end of said vanes passes.

8. A process for mounting a retaining and rigidifying component having an elastic function on a guide vane stage comprising providing a guide vane stage comprising an outer ring and an inner ring, wherein said inner and outer rings are concentric and connected together by a series of fixed vanes and positioning said retaining and rigidifying component having an elastic function between successive vanes, wherein said vanes comprise an aperture, said retaining and rigidifying component comprises a cut, shaped and folded metal sheet comprising two flat stubs which are sized so as to allow them to be housed in the apertures of two successive vanes and wherein said positioning step comprises precompressing said retaining and rigidifying component, placing said retaining and rigidifying component such that said stubs of said retaining and rigidifying component are housed in said apertures of said vanes and releasing the pressure exerted on said retaining and rigidifying component.

* * * * *